United States Patent [19]

Wyser

[11] Patent Number: 5,033,616

[45] Date of Patent: Jul. 23, 1991

[54] BLISTER PACK FOR BUTTON BATTERIES

[75] Inventor: Paul J. Wyser, Itingen, Switzerland

[73] Assignee: Renata AG, Itingen, Switzerland

[21] Appl. No.: 521,436

[22] Filed: May 10, 1990

[30] Foreign Application Priority Data

May 18, 1989 [CH] Switzerland ..... 1871/89

[51] Int. Cl.[5] ..... B65D 73/00

[52] U.S. Cl. ..... 206/333; 206/469; 206/470; 206/532; 206/538

[58] Field of Search ..... 206/333, 484, 461, 469, 206/470, 531, 532, 538, 634; 221/25, 302

[56] References Cited

U.S. PATENT DOCUMENTS

| | | | |
|---|---|---|---|
| 3,811,564 | 5/1974 | Braber | 206/469 |
| 3,835,995 | 9/1974 | Haines | 206/484 X |
| 3,905,479 | 9/1975 | Gerner et al. | 206/461 X |
| 3,912,082 | 10/1975 | Gerner et al. | 206/484 X |
| 3,924,747 | 12/1975 | Gerner | 206/484 X |
| 4,015,708 | 4/1977 | Kelm | 206/333 |
| 4,209,091 | 6/1980 | Lieberman | 206/333 |
| 4,243,144 | 1/1981 | Margulies | 206/634 X |
| 4,294,361 | 10/1981 | Margulies et al. . | |
| 4,537,312 | 8/1985 | Intini | 206/531 |
| 4,860,890 | 8/1989 | Cerny et al. | 206/333 |

FOREIGN PATENT DOCUMENTS

| | | | |
|---|---|---|---|
| 377888 | 9/1907 | France | 206/532 |
| 0165044 | 8/1985 | Japan | 206/333 |
| 1019963 | 2/1966 | United Kingdom | 206/532 |
| 1112879 | 5/1968 | United Kingdom . | |

*Primary Examiner*—Bryon P. Gehman

*Attorney, Agent, or Firm*—Ralph W. Selitto, Jr.

[57] ABSTRACT

Blister pack for button batteries (5) having a substrate card (1) of cardboard, on which a two-dimensionally stabilizing main panel (2) and an edge-oriented battery receiving area (4) are bounded by a straight line of weakness (3). On the receiving area (4) there are separating cuts (6) along the line of weakness (3) at right angles from the latter to the substrate card edge, as a result of which individual compartments (7) are formed, which are made pivotal independently of one another about the line of weakness (3).

12 Claims, 1 Drawing Sheet

BLISTER PACK FOR BUTTON BATTERIES

FIELD OF THE INVENTION

The invention relates to a blister pack for button batteries according to the preamble of patent claim 1.

It is known to market button batteries in multiple arrangement in blister packs. Such packs are based on a cardboard piece with usually a one-sided coating and, placed on top, a transparent plastic film with thermoformed receiving spaces for spaced-apart button batteries. Front side and rear side of the cardboard piece can be used for advertising, dating, information on contents and instructions for use. The individual batteries can preferably be released from the pack by pressing through a zonal section of the cardboard piece bounded by lines of weakness, unused batteries remaining fixed on the cardboard piece until their removal.

What is disadvantageous about there known blister packs is that the lines of weakness are often only impressed superficially, to keep the pack secure, and the opening of a battery compartment requires relatively great force. If it is considered that such battery packs are frequently used for hearing-aid batteries, to be changed relatively often, and consequently are handled principally by elderly persons, it becomes clear that battery removal should be possible with little exertion of force. Added to this is that, due to inadequately preimprinted lines of weakness, adjacent areas of the cardboard piece are also torn into undesirably, as a result of which the remaining pack may become unstable and batteries stored in it may drop out.

SUMMARY OF THE INVENTION

This gives rise to the object of proposing a blister pack for button batteries which avoids these drawbacks and provides a reliable receptacle which can be conveniently opened, for a multiplicity of individual batteries.

The way in which this object is achieved emerges from the characterizing part of claim 1. Embodiments thereof are defined by the dependent claims.

BRIEF DESCRIPTION OF THE DRAWINGS

The invention is explained below with reference to the drawings, in which.

DETAILED DESCRIPTION OF THE DRAWINGS

Figure 5:
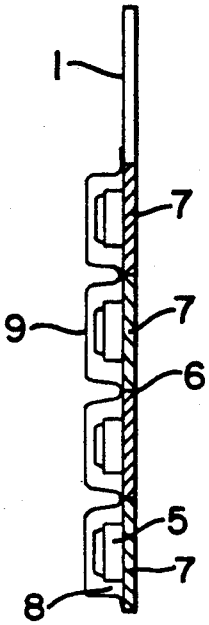
FIG. 5 shows the blister pack of FIG. 1 in longitudinal section.
Figure 1:
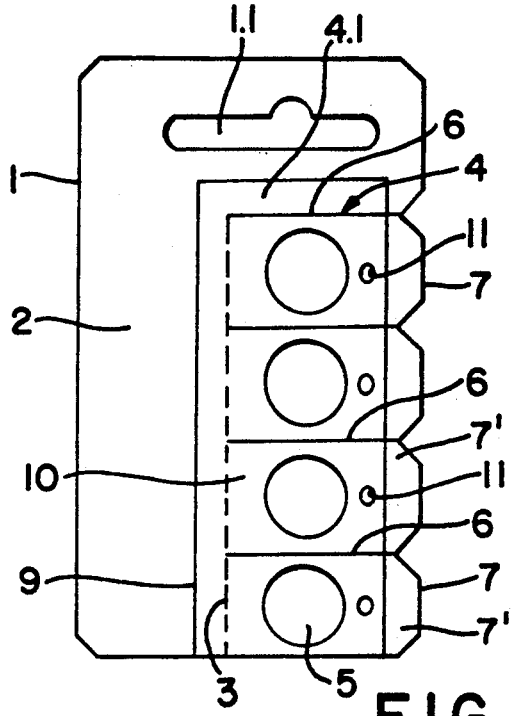
FIG. 1 shows a blister pack for button batteries in plan form.

In the drawing, 1 denotes a substrate card of a, for example, one-sidedly surface-coated (sealed) cardboard having a hanging hole 1.1 for presentation in shops. The substrate card 1 includes a stability-ensuring strip-shaped main panel 2 and a receiving area 4 for, for example, four button batteries 5, which is bounded from the said main panel by an essentially straight line of weakness 3. This receiving area 4 is subdivided by separating cuts 6, taken at right angles towards the outer edge of the substrate card 1 opposite the main panel 2 into a number of elongated individual compartments 7, which are arranged one alongside the other in a row and are joined to the main panel 2 in such a way that they can be folded out of the plane of the substrate card 1 by means of the line of weakness 3 or torn off along this line. Each compartment 7 contains on its upper side a button battery 5, and this is in turn held in a cup 8, which is formed in a transparent plastic covering film 9 by thermofilming. As shown in the drawing, the plastic covering file 9 may extend in the piece over the entire receiving area 4, including an L-shaped sealing area 4.1, have a number of cups 8, corresponding in number to the compartments 7, and be joined to the substrate card 1 in a bonding zone 10, preferably present over the entire receiving area 4, by adhesion or welding. In the case of an adhesive bonding zone 10, small, approximately punctiform welding spots 11, which are provided in each compartment 7 next to a gripping zone 7', are provided as safeguards against breaking open. In this way it can be ensured that undamaged compartments contain in each case an unused battery 5. The plastic covering film may, however, also extend in each case over only a single compartment 7 (by subdivisions which are not shown) and be detached from the main panel 2 or from the substrate card 1 when the said compartment is folded out. In both cases, it is expedient to leave uncovered at the front end of each individual compartment 7 the gripping zone 7', in which the plastic film 9 is set back to a line 9'.

Figure 2:
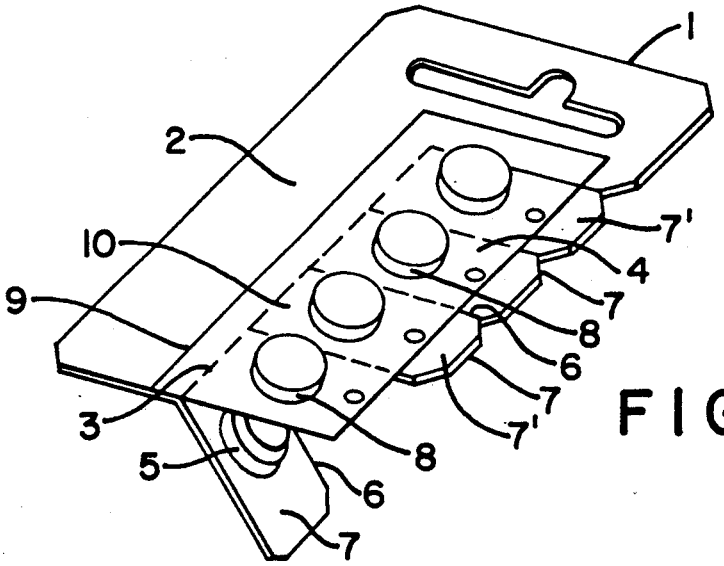
FIG. 2 shows the pack according to FIG. 1 in perspective representation with an opened battery compartment.

In FIG. 2 it is shown how an individual compartment 7 is folded away from the substrate card 1 and the battery 5 on it can be removed.

Figure 3:
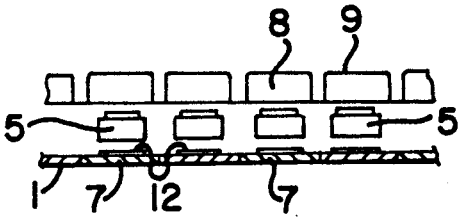
FIG. 3 shows a diagrammatic partial representation of a blister pack for button batteries of the zinc-air type.

FIG. 3 shows in a diagrammatic manner of representation the use of the invention for button batteries of the zinc-air type. In the case of such batteries, the case bottom is provided with openings of 0.2–0.3 mm diameter for the access of atmospheric oxygen. In order to counteract a discharge during storage, these openings are expediently covered with a self-adhesive cover during battery production. According to FIG. 3, such a cover, which has to be adhesively fixed onto each case bottom and removed again before insertion into an appliance, can be avoided by each compartment 7 being provided in the storage area of a button battery 5 with a sealing zone 12 of an oxygen-impermeable adhesive which remains elastic over a considerable time. This adhesive may be, for example, of the type used in the case of self-adhesive labels. The sealing zone 12 may extend individually over the zone in which an individual battery 5 is placed or reach over the whole area of all compartments 7, to the extent that they are covered by the plastic covering film 9. The batteries 5 are then packed in the way described above with a plastic covering film 9 having thermoformed cups 8.

The batteries 5 and the plastic covering film 9 are both bonded to the adhesive of the sealing zone 12. In the case of a blister pack for zinc-air batteries, the latter are urged by the cup bottom against the sealing zone 12, in order to prevent a detachment from the adhesive layer. It should be noted that the adhesive is not to bond to the batteries, in order to avoid contact difficulties.

When unpacking the individual batteries, at first they remain bonded to the self-adhesive sealing zone 12 and can be easily pulled off there by hand.

Blister packs of the type according to the invention having an adhesive bonding zone 10 over the upper side of the compartments 7 (to the extent that they are covered by the plastic covering film 9), are preferably suitable for disposing of the used button batteries, by the said batteries being introduced into an already broken-open compartment during a battery change and subsequently disposed of together with the completely broken-open pack.

The welding spots 11 which have not been broken open show in each case which of the compartments 7 contain a battery 5 which has still not been used.

Figure 4:
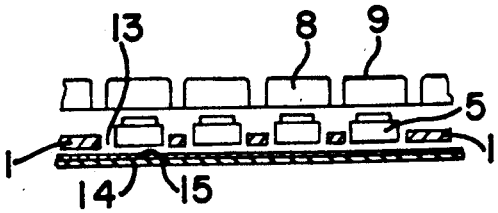
FIG.4 shows another embodiment of the blister pack shown in FIG. 3.

According to FIG. 4 the substrate card 1 is provided, in contrast to the embodiment of FIG. 3, with openings 13 corresponding to the contours of the button batteries 5. All openings 13 are covered by a supporting sheet 14 which is subdivided in accordance with compartment 7 and coated with an oxygen—impermeable adhesive 15. The adhesive 15 may be a silicon based bonding agent. The supporting sheet 14 may be of polyethylene and is preferably also oxygen-impermeable. In consideration of this arrangement the openings normally provided on the zinc-air type batteries are uncovered by merely removing the supporting sheet 14. The removal of the sealing labels, which are normally provided on the said batteries, is thus avoided.

I claim:

1. A blister pack for button batteries, comprising a transparent covering film having a plurality of cups, each cup being sized and shaped so as to receive a button battery; a substrate card having a receiving area bordered on one side by a first peripheral edge of said substrate card and on an opposite side by a line of weakness extending parallel to said first peripheral edge intermediate said first peripheral edge and a second peripheral edge of said substrate card, said second peripheral edge being opposite to said first peripheral edge, said receiving area including a plurality of separating cuts extending between said line of weakness and said first peripheral edge in a direction generally perpendicular thereto so as to form a plurality of individual flaps arranged side-by-side along said receiving area, each flap being pivotable about said line of weakness independently of the other of said flaps and having a free end remote from said line of weakness; and attaching means for attaching said covering film to said substrate card and to said flaps thereof such that each cup of said covering film overlies a corresponding one of said flaps to form a plurality of compartments for button batteries and such that said free ends of said flaps form an extremity of said blister pack to thereby facilitate selective accessing of button batteries contained in said compartments by permitting said flaps to be individually gripped and then independently pivoted about said line of weakness.

2. A blister pack according to claim 1, wherein said free end of each of said flaps extends outwardly beyond said covering film to form an exposed gripping zone.

3. A blister pack according to claim 1 or 2, wherein said covering film extends as a single piece over the entirety of said receiving area, and wherein said attaching means includes an elongated bonding zone between said covering film and said flaps and a plurality of punctiform welding spots, each of said welding spots releasably securing a corresponding one of said flaps to said covering film such that each of said compartments is releasably secured by a corresponding one of said welding spots.

4. A blister pack according to claim 3, wherein said bonding zone includes a reusable adhesive whereby opened compartments may be resecured thereby functioning as a depository for used button batteries.

5. A blister pack according to claim 1 or 2, wherein said covering film is divided into a plurality of separable sections, each of said sections overlying a corresponding one of said flaps, whereby said compartments may be individually detached from said blister pack.

6. A blister pack according to claim 1, wherein each of said compartments includes a sealing zone of oxyen-impermeable adhesive onto which a zinc-air button battery is to be placed.

7. A blister pack according to claim 6, wherein said oxygen-impermeable adhesive extends over the portion of each of said flaps which underlies said covering film.

8. A blister pack according to claim 1, wherein said substrate card further includes a plurality of openings extending from a first planar surface proximate to said covering film to a second planar surface remote from said covering film; each of said openings being sized and shaped to receive a button battery, and a supporting sheet adhesively attached to said second planar surface of said substrate card.

9. A blister pack according to claim 8, wherein said supporting sheet is attached to said second planar surface of said substrate card by an oxygen-impermeable adhesive.

10. A blister pack according to claim 8, wherein said adhesive is a silicon-based bonding agent.

11. A blister pack according to claim 8, wherein said supporting sheet is made from an oxygen-impermeable material.

12. A blister pack according to claim 8, wherein said supporting sheet is divided into a plurality of separable sections, each of said sections overlying a corresponding one of said flaps, whereby said compartments may be individually detached from said blister pack.

* * * * *